US008148911B2

(12) United States Patent
Chen et al.

(10) Patent No.: US 8,148,911 B2
(45) Date of Patent: Apr. 3, 2012

(54) CURRENT-BALANCE CIRCUIT AND BACKLIGHT MODULE HAVING THE SAME

(75) Inventors: Ke-Horng Chen, Banciao (TW); Chia-Lin Chiu, Jhongli (TW); Ling Li, Hualien (TW); Chia-Lin Liu, Daya Township, Taichung County (TW); Chi-Neng Mo, Jhongli (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 420 days.

(21) Appl. No.: 12/432,054

(22) Filed: Apr. 29, 2009

(65) Prior Publication Data

US 2010/0148679 A1 Jun. 17, 2010

(30) Foreign Application Priority Data

Dec. 12, 2008 (TW) ..... 97148618 A

(51) Int. Cl.
*H05B 41/16* (2006.01)

(52) U.S. Cl. ..... 315/250; 315/209 R; 315/294; 315/324; 315/210; 345/83

(58) Field of Classification Search ..... 315/209 R, 315/210, 246, 247, 250, 291, 294, 312, 324
See application file for complete search history.

(56) References Cited

U.S. PATENT DOCUMENTS

| | | | | |
|---|---|---|---|---|
| 7,145,295 | B1 * | 12/2006 | Lee et al. | 315/291 |
| 7,439,945 | B1 * | 10/2008 | Awalt et al. | 345/83 |
| 7,605,550 | B2 * | 10/2009 | Ferentz et al. | 315/312 |
| 2004/0251854 | A1 * | 12/2004 | Matsuda et al. | 315/291 |
| 2006/0082412 | A1 | 4/2006 | D'Angelo et al. | |

* cited by examiner

*Primary Examiner* — Shawki S Ismail
*Assistant Examiner* — Christopher Lo
(74) *Attorney, Agent, or Firm* — Muncy, Geissler, Olds & Lowe, PLLC

(57) ABSTRACT

The present invention relates to a current-balance circuit and a backlight module having the same. The current balance circuit includes a current balance unit, a control unit, and a detection unit. The current balance unit is connected to a plurality of light units to regulate the current of the plurality of light units, independent from the effects of input voltage. The detection unit is connected to the plurality of light units and the current balance unit to detect the minimum operating voltage for the plurality of light units. The control unit, connected to the current balance unit, controls the operation of the plurality of light units.

15 Claims, 4 Drawing Sheets

CURRENT-BALANCE CIRCUIT AND BACKLIGHT MODULE HAVING THE SAME

TECHNICAL FIELD

The present invention generally relates to circuits and, more particularly, to a current balance circuit for backlight applications and backlight module thereof.

BACKGROUND

It would lead to a difference between the internal resistance and turn-on voltage of light emitting diodes (LEDs) by the conventional LED driving methods due to the differences in process or material, internal resistance on LEDs is easily affected by the process, temperature or the length/location of the circuit wiring connected to the resistance, which generates errors on the equivalent resistance during actual operation, and thereby generates errors on the output driving current. To drive the driving current or a plurality of driving currents with different loads via one or more connected current mirrors would also lead to errors.

Please refer to U.S. Patent Publication No. 2006/0082412, the prior art discloses a method of utilizing operational amplifiers to improve current matching between channels. A multi-channel current regulator includes two or more channels, and each channel acts as a current source or sink for each respective load. Each channel regulator regulates the load current so that the load current is proportional to an input voltage supplied to the channel. An operational amplifier is shared between channels. Each channel is selected in a rotating sequence for connection to the amplifier. Each channel is selected to initialize a two stage refresh cycle. During the first period, the output of the operational amplifier is charged until the output voltage matches the driving voltage of the selected channel. During the second period, the output of the operational amplifier is adjusted until the load current of the selected channel is proportional to voltage Vset. The above mentioned circuit utilizes a selector to switch different LEDs connected in series, and determines which LED is turned on for illumination.

However, the device or circuit disclosed by the prior art has a more complex circuit, requiring a larger amount of operational amplifier elements and a higher cost on production.

SUMMARY OF THE INVENTION

Based on the above, an object of the present invention is to provide a current balance circuit and a backlight module with the current balance circuit.

An object of the present invention is to reduce the relationship between the current of light units and the voltage of a boost converter, allowing the current to maintain a constant relationship, and independent of the voltage's effects.

An object of the present invention is to allow the operating voltage of the light units to maintain at the minimum operating voltage, improving the backlight module's efficiency.

The present invention discloses a current balance circuit, comprising: a reference current source unit, to provide regulated current; a current balance unit, connected to a plurality of light units, to maintain regulated current between the plurality of light units, be independent from the effects of input voltages of the plurality of light units; a dimming control unit, connected to the reference current source unit and the current balance unit, to control the operation of the current balance unit.

The present invention also discloses a backlight module with current balance circuit, comprising: a plurality of light units; a boost unit, connected to the plurality of light units, to convert the input voltage and provides voltage to the plurality of light units; a current balance unit, connected to the plurality of light units, wherein the current balance unit adjusts the current of the plurality of light units to maintain at a regulated value, independent from the effects of the output voltage of the boost unit; a dimming control unit, connected to the current balance unit, controls the operation of the current balance unit; a reference current source unit, connected to the dimming control unit, to provide regulated current; a control unit, connected to the dimming control unit, transmits pulse width modulated signal to control the operation of the plurality of light units; and a detection unit, connected to the plurality of light units and the current balance unit, to detect the minimum operating voltage of the plurality of light units.

The current balance circuit described in the present invention may effectively decrease the factors (caused by the characteristics of boost converter and LED) that affect the current, allowing the currents in the serial current path which drive the LED to remain constant in order to improve the reliability of driving currents and luminance for backlight, and obtaining the anticipated luminance for each LED. If a single LED serial path is damaged, the circuit described in the present invention would ignore the error signal, allowing the whole back light module system to operate normally. The amount of error for LEDs connected in series (LED serial paths) has been proved by experiments to be less than 0.1%.

The present invention may detect the minimum operating voltage for LEDs connected in series, and adjusts the output voltage to provide minimum operating voltages to a plurality of light units, to reduce extra power consumptions and raise the efficiency of backlight modules.

In addition, the design of the current balance circuit in the present invention is less complex (only uses two operational amplifiers) compared to prior art, and reducing the power consumption, area of the chip, and amount of components used, thereby lowers the cost. Also, $R_{ext}$ is a resistor placed outside of the chip, which may lower the number of pins on chip for the LED driving circuit, and another advantage is that the driving current for the LED may be defined by the user, which adjusts the current outside the chip, without any need to re-modify the chip's internal circuit.

BRIEF DESCRIPTION OF THE DRAWINGS

The components, characteristics and advantages of the present invention may be understood by the detailed descriptions of the preferred embodiments outlined in the specification and the drawings attached.

DETAILED DESCRIPTION

Some preferred embodiments of the present invention will now be described in greater detail. However, it should be recognized that the preferred embodiments of the present invention are provided for illustration rather than limiting the present invention. In addition, the present invention can be practiced in a wide range of other embodiments besides those explicitly described, and the scope of the present invention is not expressly limited except as specified in the accompanying claims.

References in the specification to "one embodiment" or "an embodiment" refers to a particular feature, structure, or characteristic described in connection with the preferred embodiments is included in at least one embodiment of the present invention. Therefore, the various appearances of "in one embodiment" or "in an embodiment" do not necessarily refer to the same embodiment. Moreover, the particular feature, structure or characteristic of the invention may be appropriately combined in one or more preferred embodiments.

The present invention discloses a current balance circuit and backlight module thereof. The present invention utilizes the current balance circuit to decrease the influencing factors towards current caused by the characteristics of boost converter and light emitting diode (LED), allowing the current that drives the LEDs connected in series (LED serial paths) to remain constant in order to improve the reliability of driving current and luminance of backlight. The amount of errors for currents between the two LEDs connected in series has been proved by experiment to be less than 0.1%.

Figure 1:
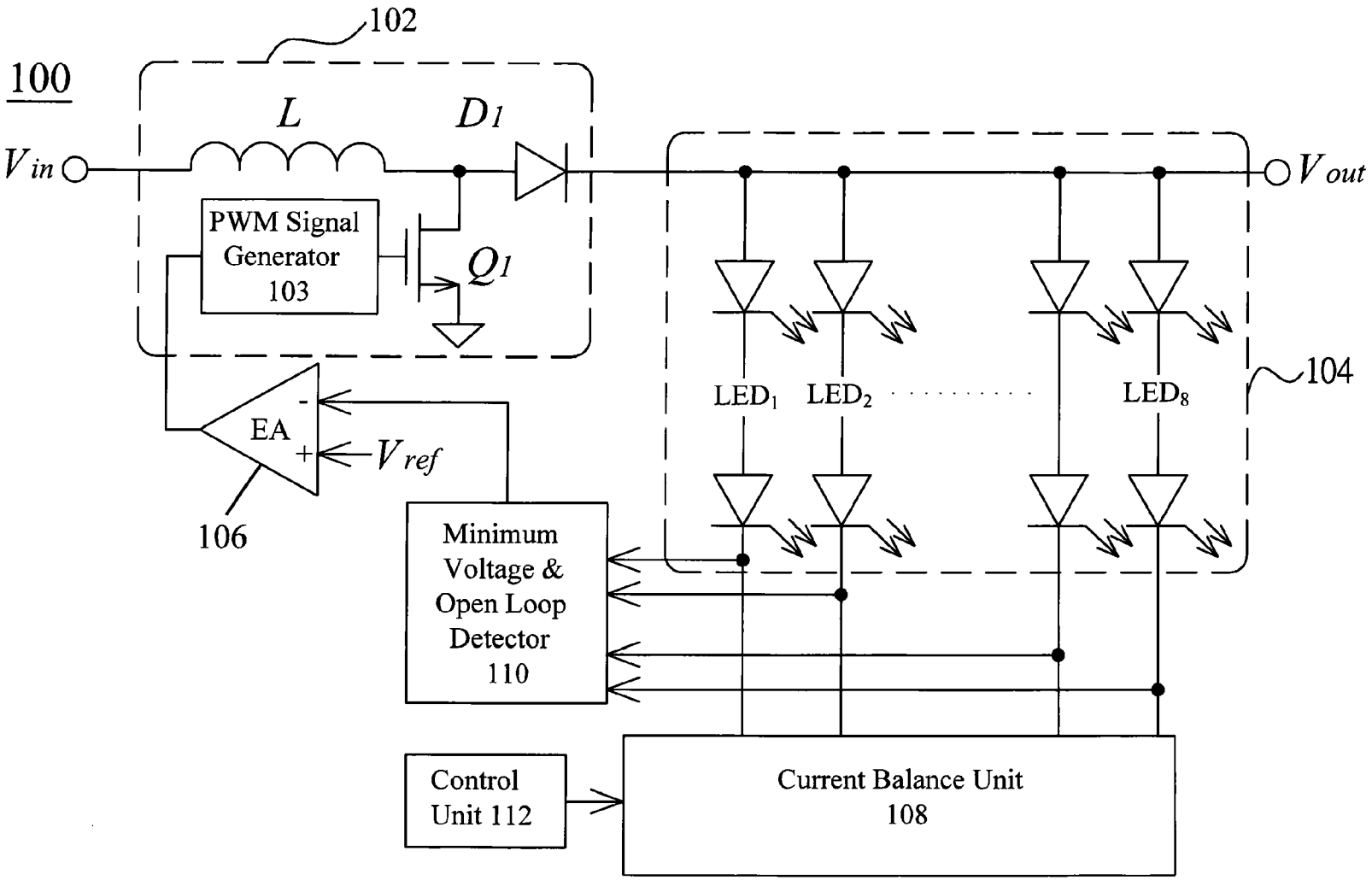
FIG. 1 illustrates the diagram of a backlight module with current balance circuit according to a preferred embodiment of the present invention.

Refer to FIG. 1, which illustrates the diagram of a backlight module with current balance circuit according to a preferred embodiment of the present invention. Backlight module 100 comprises a boost unit 102, a plurality of light units 104, an error amplifier 106, a current balance circuit 108, a minimum voltage and open loop detector 110 and a control unit 112. Boost unit 102 includes a pulse width modulation (PWM) signal generator 103 and a booster converter made up of an inductor L, a power transistor $Q_1$, and a diode $D_1$. In one embodiment, one end of inductor L is connected to the drain of power transistor $Q_1$ and to the positive terminal of diode $D_1$, while the other end of inductor L is connected to input $V_{in}$. The input end of the PWM signal generator 103 is connected to the output of error amplifier 106, whereas the output end of the PWM signal generator 103 is connected to the gate of power transistor $Q_1$.

Boost unit 102 is connected to the plurality of light units 104 and error amplifier 106. The goal for the boost unit 102 is to adjust the input voltage $V_{in}$, and provides the voltage to the plurality of light units 104. Through the PWM signal transmitted by PWM signal generator 103, the On-time of power transistor $Q_1$ may be controlled, thereby alters the output voltage of boost unit 102 and thus adjusts the luminance for the plurality of light units 104. The On-time of power transistor is proportional to the charge time of inductor L. Therefore, if the On-time is increased, the voltage from boost unit 102 that is supplied to the plurality of light units 104 also increases, and the higher the output voltage $V_{out}$. Conversely, if the On-time is decreased, the output voltage $V_{out}$ decreases.

The plurality of light units 104 is made up of 3 light sources: red, green and blue, which form the light source of backlight module 100. In a preferred embodiment, the red, green and blue light sources may be red, green and blue LEDs. In this embodiment, the plurality of light units 104 are comprised of multiple LEDs connected in series.

The input of error amplifier 106 is connected to reference voltage $V_{ref}$, while the other terminal is connected to minimum voltage and open loop detector 110. The result is outputted from error amplifier 106 to PWM signal generator 103. Error amplifier 106 draws on the feedback voltage of minimum voltage and open loop detector 110, and reference voltage $V_{ref}$ for comparison to determine the pulse width of the PWM signal and thereby adjust the output voltage for boost unit 102.

Current balance circuit 108 is connected to the plurality of light units 104 and control unit 112. Current balance circuit 108 is utilized to maintain the current balance for each of the LED connected in series within the plurality of light units 104 to maintain balance on the luminance for the plurality of light units 104.

Minimum voltage and open loop detector 110 is connected to the plurality of light units 104 and current balance circuit 108. Minimum voltage and open loop detector 110 may detect if the plurality of light units 104 are damaged (or open-circuit), or determine the minimum operating voltage for LEDs connected in series within the plurality of light units 104.

As control unit 112 decides a particular path is turned off (open circuit), the LEDs connected in series within the plurality of light units 104 is not turned on. Consequently, there is no voltage drop, detector 110 would detect a high voltage and ignore the signal, and boost unit 102 continues to output a fixed voltage. If under normal mode, detector 110 would detect the minimum operating voltage on the LED path, and supply the signal to boost unit 102. After that, PWM signal generator 103 would adjust the On-time for power transistor $Q_1$, allowing boost unit 102 to output minimum operating voltage. Minimum operating voltage detection allows backlight module 100 to achieve optimized efficiency. For example, if the minimum operating voltage for the plurality of LEDs connected in series within the plurality of light units 104 is 16 volts, and the voltage supplied by boost unit 102 is 18 volts, then the On-time for power transistor $Q_1$ may be adjusted, where optimal efficiency may be achieved at 16 volts.

Control unit 112 is connected to current balance circuit 108. By controlling the PWM and $\overline{EN}$ signals transmitted to current balance circuit 108, control unit 112 may control the operation and luminance of the LEDs connected in series.

Figure 2:
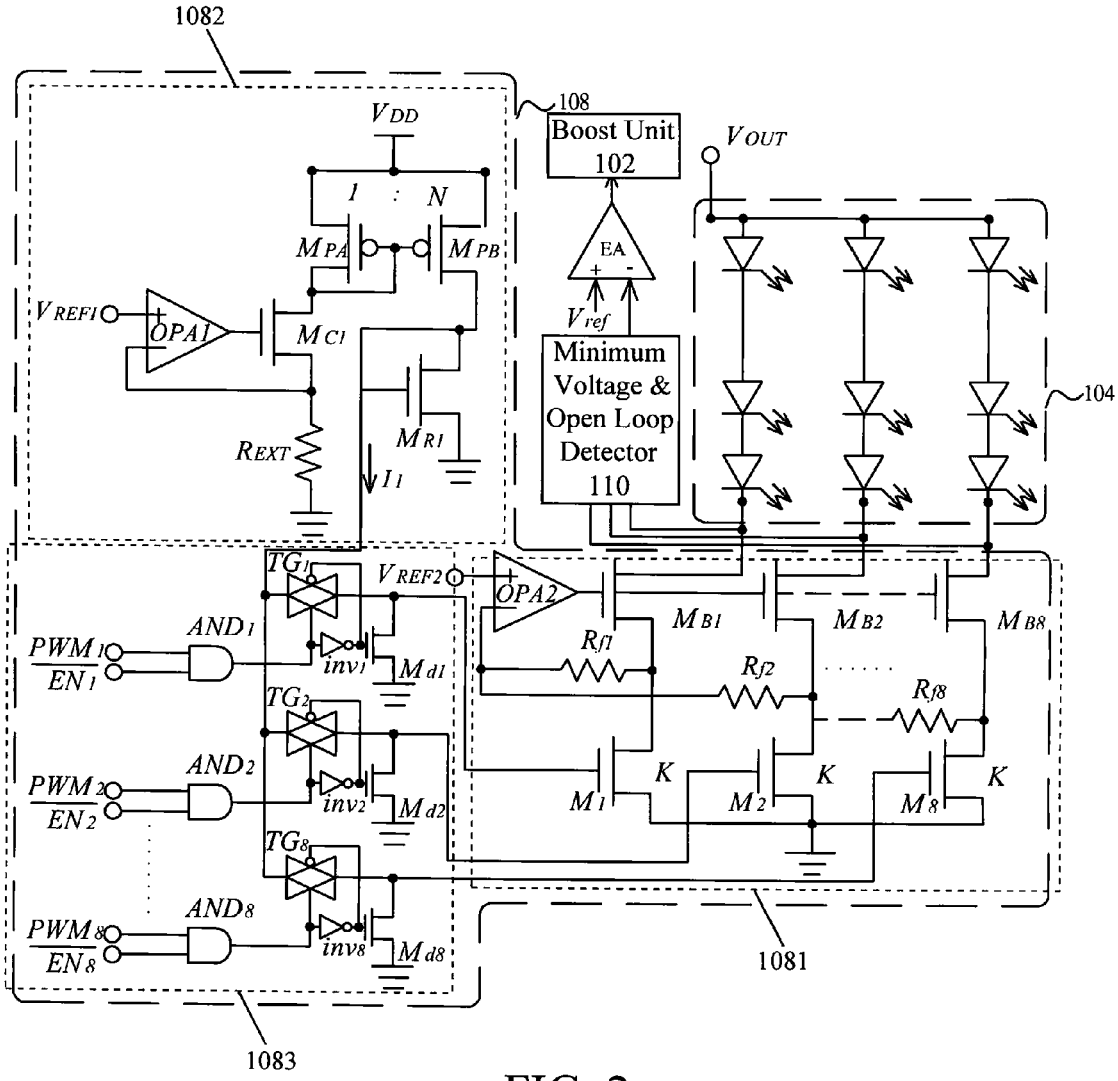
FIG. 2 illustrates the circuit diagram of a current balance unit according to a preferred embodiment of the present invention.

Refer to FIG. 2, it shows the circuit diagram of a current balance circuit 108 according to a preferred embodiment. Current balance circuit 108 is made up of current balance unit 1081, reference current source unit 1082 and dimming control unit 1083. Current balance unit 1081 is connected to a plurality of light units 104, minimum voltage and open loop detector 110. The plurality of light units 104 is made up of a plurality of LEDs connected in series. The number of LEDs connected in series needs to be even, as minimum voltage and open loop detector 110 compares the magnitude of the voltage for every two LED connected in series, and selects the path with the minimum operating voltage in the end.

Reference current source unit 1082 is a current mirror circuit, connected to dimming control unit 1083. The goal of reference current source unit 1082 is to provide a stable current supply, and avoid perturbation current of a single LED serial path from affecting the overall bias current. Dimming control unit 1083 is connected between reference current source unit 1082 and current balance unit 1081, to control the operation of current balance unit 1081.

Current balance circuit 108 includes two operational amplifiers (OPA) $OPA_1$ and $OPA_2$. Operational amplifier $OPA_1$ is used to generate a stable reference current source, whereas operational amplifier $OPA_2$ is used for voltage regulation control. The current mirror circuit that utilizes reference current source unit 1082 may control the current easily and directly. However, the channel length modulation effect would affect the performance of the current mirror. The channel length modulation effect generated by the current mirror may be suppressed by the path in current balance unit 1081, where the path is formed by connecting operational amplifier $OPA_2$ to resistors ($R_{f1}$-$R_{f8}$) and metal oxide semiconductor switches ($M_{B1}$-$M_{B8}$).

The output voltage of boost unit 102 is affected by the internal temperature and operating time. If constant current control is utilized, the LED luminance for the plurality of light units 104 may suppress the direct impact of output voltage from boost unit 102.

$$I_{LED} = \frac{V_{REF1}}{R_{ext}} \times N \times K \tag{1}$$

Resistor $R_{ext}$ is a resistor placed outside of the driver chip, and current $I_{LED}$ may be controlled by adjusting voltage $V_{REF1}$ or resistor $R_{ext}$. The current balance circuit 108 may provide a constant current, to obtain a higher current balance characteristic and maintain a high and stable current.

Within dimming control unit 1083, inputs PWM and $\overline{EN}_1$ for the control gate ($AND_1$-$AND_8$) receive control signals from control unit 112 for the control of dimming and enabling, thus control the operation of the LEDs connected in series. Transmission gate ($TG_1$-$TG_8$) is utilized to control the current output of reference current source. When input signal $\overline{EN}_1$ is open, it allows for the LEDs connected in series to be turned on, and when signal $\overline{EN}_1$ is closed, the LEDs do not need to be illuminating, and would not affect other paths. Input PWM is utilized to control the On-time of LEDs.

As each LED path and its respective circuits have the same configuration, the repeating circuit structures and operating procedures are not described. Please refer to Table 1 for the operations of LED path $LED_1$.

TABLE 1

| $PWM_1$ | $\overline{EN}_1$ | $AND_1$ |
|---|---|---|
| 0 | 0 | 0 |
| 0 | 1 | 0 |
| 1 | 0 | 0 |
| 1 | 1 | 1 |

When input of $PWM_1$ equals low voltage "0" (which means that there is no input of control signal), input of $\overline{EN}_1$ equals low voltage "0" (which means that signal is prohibited from passing through transmission gate $TG_1$), output of AND gate $AND_1$ is "0", transmission gate $TG_1$ is closed (Off), switch $MB_1$ is On, and the current generated by reference current source unit 1082 and the switch on current balance unit 1081 is released to avoid switch loss in the current balance unit 1081 due to heat.

When input of $PWM_1$ equals low voltage "0", input of $\overline{EN}_1$ equals high voltage "1", then output of AND gate $AND_1$ is "0", transmission gate $TG_1$ cannot be turned on, switch $MB_1$ is On, and the current generated by reference current source unit 1082 and the switch on current balance unit 1081 is released to avoid switch loss in the current balance unit 1081 due to heat.

When input of $PWM_1$ equals high voltage "1", input of $\overline{EN}_1$ equals low voltage "0", then output of AND gate $AND_1$ is "0", transmission gate $TG_1$ is closed, switch $MB_1$ is On, and the current generated by reference current source unit 1082 and the switch on current balance unit 1081 is released to avoid switch loss in the current balance unit 1081 due to heat.

When input of $PWM_1$ equals high voltage "1", input of $\overline{EN}_1$ equals high voltage "1", then output of AND gate $AND_1$ is "1", which initiates the transmission gate $TG_1$ to be turned on, and switch $MB_1$ is closed. The predefined current $I_1$ may be supplied to the gate of switch $M_1$ to turn on switch $M_1$, therefore path LED, is turned on and illuminates. The On-time (luminance) of the LED path may be adjusted via controlling the control signal inputted into the PWM.

Figure 3:
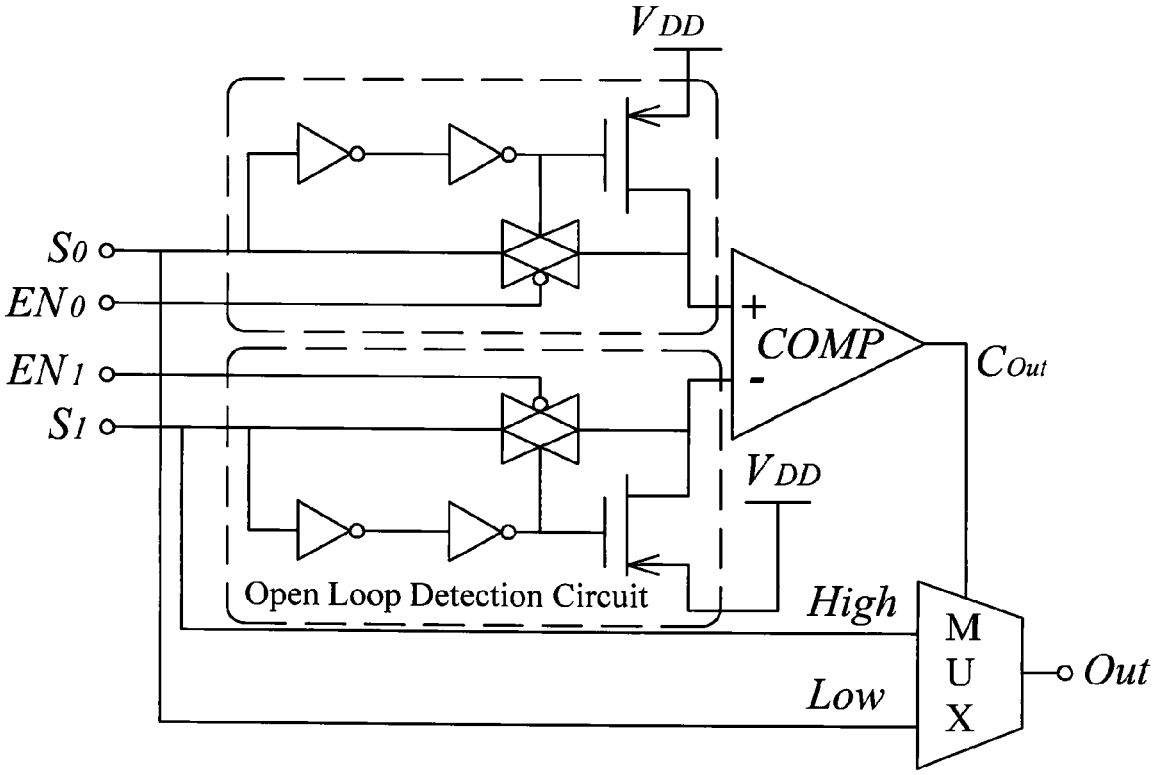
FIG. 3 illustrates the circuit diagram of a minimum voltage and open loop detector according to a preferred embodiment of the present invention.

Please refer to the embodiment in FIG. 3 for the circuit diagram of minimum voltage and open loop detector 110. For simplification, FIG. 3 only shows the very basic structure of the detector circuit, a circuit with only 2 LED paths being inputted. Minimum voltage and open loop detector 110 compares the magnitude of the voltage for every two serial paths, to detect the minimum operating voltage for the LED path.

Minimum voltage and open loop detector 110 is made up of two open loop detection circuits, a comparator and an analog selector (multiplexer) Mux. The open loop detection circuit is made up of two inverters, a transmission gate and a transistor switch. The transistor switch may include a NMOS switch. Inputs $S_0$ and $S_1$ are connected to each LED serial path respectively, to capture the voltage signal. $EN_0$ and $EN_1$ signal are supplied by control unit 112. Minimum voltage and open loop detector 110 capture the voltage signal of the LED serial paths, then the signal is fed-back to boost unit 102 via error amplifier 106. Depending on the voltage signal, boost unit 102 adjusts the output voltage to provide the minimum operating voltage for the plurality of light units 104, which reduces extra power consumption and improves the efficiency of backlight modules.

Open loop detection circuit is able to determine the incorrect input signal. If the LED serial paths within light units 104 is burnt or under non-action mode, then the input S of the open loop detection circuit will be "0". Under this logic circuit scheme, an input value of "0" represents an error signal for a incorrect input; and the correct voltage signal, where the input is less than the supply source voltage $V_{DD}$ and greater than ground GND is "1", as shown in Table 2.

TABLE 2

| $S_0$ | $EN_0$ | $S_1$ | $EN_1$ | Comp+ | Comp− | $C_{out}$ | Out |
|---|---|---|---|---|---|---|---|
| 0 | 1 | 0 | 1 | VDD | VDD | X (unknown) | 1 (open circuit) |
| 0 | 1 | 1 | 0 | VDD | data | 1 | $S_1$ (data) |
| 1 | 0 | 0 | 1 | data | VDD | 0 | $S_0$ (data) |
| 1 | 0 | 1 | 0 | data | data | min | min |

When $S_0$ equals error signal "0", transmission gate is Off, transistor switch is On, and input comp+ for comparator is $V_{DD}$. When $S_1$ equals error signal, transmission gate is Off, transistor switch is On, then input comp− for comparator is $V_{DD}$, thus comparator output $C_{out}$ is unknown. The output of analog selector Mux would be "1" to represent open circuit.

When $S_0$ equals "0", transmission gate is closed, transistor switch is On, and input comp+ for comparator is $V_{DD}$. When $S_1$ equals "1", transmission gate is On, transistor switch is closed, input comp− for comparator equals data (the actual voltage signal captured by the detection circuit), thus comparator output $C_{out}$ is "1", analog selector Mux would output the voltage signal $S_1$.

When $S_0$ equals "1", transmission gate is On, transistor switch is closed, and input comp+ for comparator equals data. When $S_1$ equals "0", transmission gate is closed, transistor switch is On, input comp− for comparator equals $V_{DD}$, thus comparator output $C_{out}$ is "0", analog selector Mux would output signal $S_0$.

When $S_0$ equals "1", transmission gate is On, transistor switch is closed, and input comp+ for comparator equals data. When $S_1$ equals "1", transmission gate is On, transistor switch is closed, input comp− for comparator equals data, thus comparator output $C_{out}$ would be "min", meaning that analog selector Mux would output the lower voltage signal among $S_0$ and $S_1$, realizing the goal for minimum voltage detection.

Figure 4:
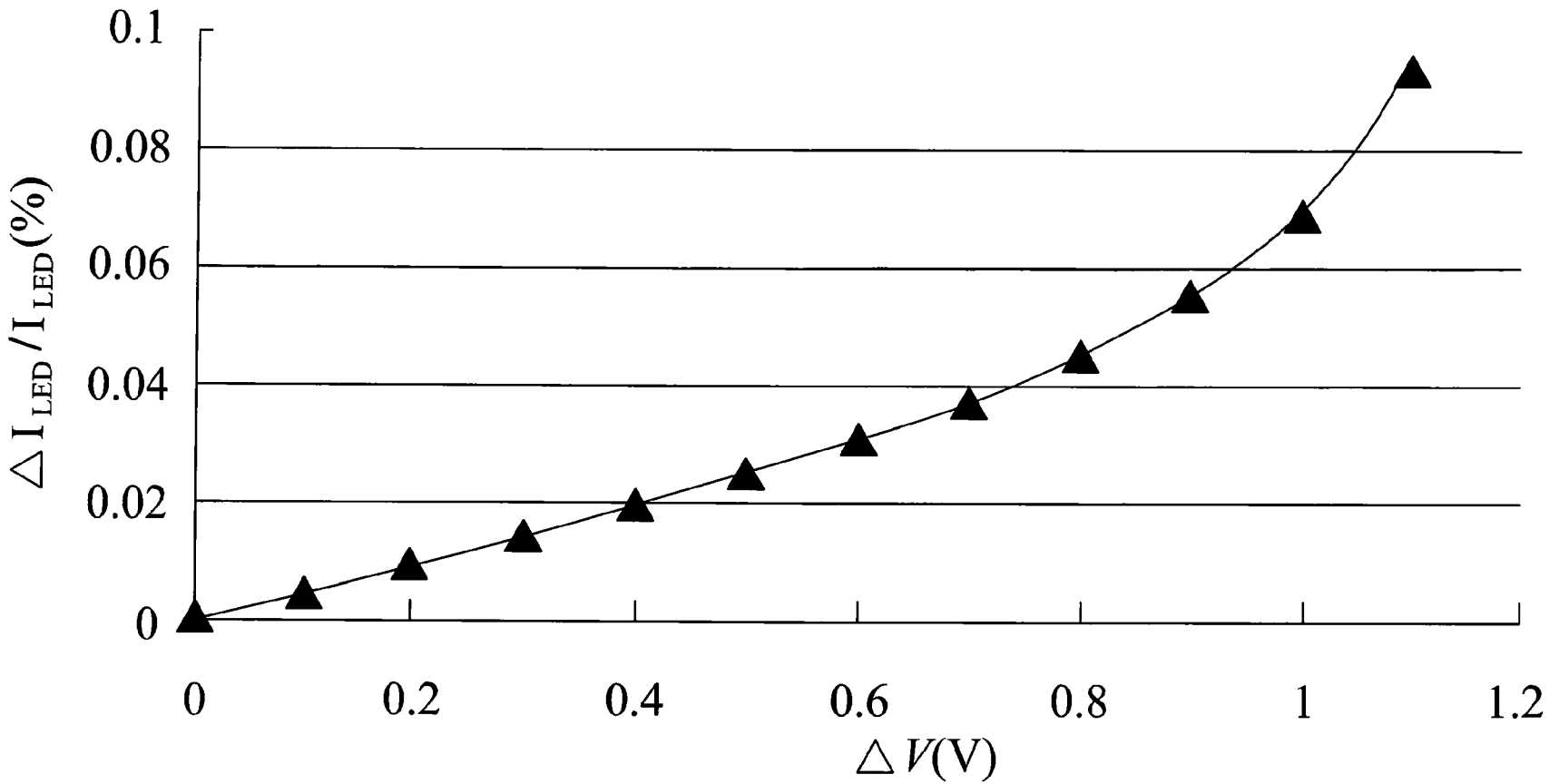
FIG. 4 illustrates the relationship diagram for voltage and current according to a preferred embodiment of the present invention.

Referring to the analysis results in FIG. 4, if voltage change is less than 0.2V, current change is approximately 0.01%. If voltage change is greater than 1.1V, then the current change is roughly 0.1%. These results have proved that the present invention is able to provide a stable current supply without the direct influence from the boost converter voltage, and effectively improve the reliability of driving current and luminance for LEDs.

The current balance circuit described in the present invention may effectively decrease the factors (caused by the characteristics of boost converter and LED) that affect the current, allowing the currents in the serial current path which drive the LED to remain constant in order to improve the reliability of driving current and luminance for backlight, and obtaining the anticipated luminance for each LED. If a single LED serial path is damaged, the circuit described in the present invention would ignore the error signal, allowing the whole back light module system to operate normally. The amount of error for currents between the two LEDs connected in series has been proved by experiment to be less than 0.1%.

$$\begin{aligned}\delta(\%) &= \frac{\Delta I_D}{\frac{I'_{D1} + I'_{D2}}{2}} \\ &= \frac{K'_n(V_{GS} - v_t)^2\lambda(2I_R R)}{K'_n(V_{GS} - v_t)^2(1 + \lambda V_{REF})} \\ &= \frac{2\lambda I_R R}{(1 + \lambda V_{REF})} \\ &\cong 2\lambda I_R R \\ &\cong 0.1\end{aligned}$$

$$\lambda = 10^{-3};\ I_R = 10^{-3};\ R = 0.5K$$

The present invention may detect the minimum operating voltage of the LED serial paths, adjust the output voltage to provide minimum operating voltages to a plurality of light units, and reduce extra power consumptions and raises the efficiency of backlight modules.

In addition, the design of the current balance circuit in the present invention is less complex (only uses two operational amplifiers) compared to prior art, and reducing the power consumption, area of the chip, and amount of components used, thereby lowers the cost. Also, $R_{ext}$ is a resistor placed outside of the chip, which may lower the number of pins on chip for the LED driving circuit, and another advantage is that the driving current for the LED may be defined by the user, which adjusts the current outside the chip, without any need to re-modify the chip's internal circuit.

The foregoing descriptions are preferred embodiments of the present invention. As is understood by a person skilled in the art, the aforementioned preferred embodiments of the present invention are illustrative of the present invention rather than limiting the present invention. The present invention is intended to cover various modifications and similar arrangements included within the spirit and scope of the appended claims, the scope of which should be accorded the broadest interpretation so as to encompass all such modifications and similar structures.

What is claimed is:

1. A current balance circuit, comprising:

a reference current source unit, to provide stable current;

a current balance unit, connected to a plurality of light units, allows current between said plurality of light units to remain stable, independent from input voltage of said plurality of light units;

a boost unit, connected to said plurality of light units to convert input voltage and supply voltage to said plurality of light units;

a dimming control unit, connected to said reference current source unit and said current balance unit, controls operation of said current balance unit;

a control unit, connected to said dimming control unit, transmits pulse width modulation (PWM) signal to control operation for said plurality of light units; and a detection unit, connected to said plurality of light units and said current balance unit, to detect minimum operating voltage for said plurality of light units;

wherein said detection unit includes, a comparator;

a plurality of open loop detection circuits, each connected to a plurality of inputs of said comparator; and an analog selector, connected to output of said comparator, for selection of input signal.

2. The current balance circuit of claim 1, wherein said plurality of light units is made up of a plurality of light emitting diodes (LEDs) connected in series (LED serial paths).

3. The current balance circuit of claim 2, wherein said LEDs include red, green or blue LEDs.

4. The current balance circuit of claim 2, wherein number of said LEDs connected in series is even numbered.

5. The current balance circuit of claim 1, wherein said dimming control unit receives said pulse width modulation (PWM) signal to adjust luminance for said plurality of light units.

6. A backlight module with current balance circuit, comprising:

a plurality of light units;

a boost unit, connected to said plurality of light units to convert input voltage and supply voltage to said plurality of light units;

a current balance unit, connected to said plurality of light units, wherein said current balance unit adjusts current for said plurality of light units to remain stable, independent from output voltage of said boost unit;

a dimming control unit, connected to said current balance unit, controls operation of said current balance unit;

a reference current source unit, connected to said dimming control unit to supply stable current;

a control unit, connected to said dimming control unit, transmits PWM signal to control operation for said plurality of light units; and a detection unit, connected to said plurality of light units and said current balance unit, to detect minimum operating voltage for said plurality of light units;

wherein said detection unit includes, a comparator;

a plurality of open loop detection circuits, each connected to a plurality of inputs of said comparator; and an analog selector, connected to output of said comparator, for selection of input signal.

7. The backlight module with current balance circuit of claim 6, wherein said plurality of light units is made up of a plurality of LEDs connected in series.

8. The backlight module with current balance circuit of claim 7, wherein said LEDs include red, green or blue LEDs.

9. The backlight module with current balance circuit of claim 7, wherein number of said LEDs connected in series is even numbered.

10. The backlight module with current balance circuit of claim 6, wherein said detection unit sends feedback signal to said boost unit, thereby adjusts said output voltage of said boost unit to said minimum operating voltage.

11. The backlight module with current balance circuit of claim 6, wherein said detection unit include a minimum voltage and an open loop detector.

12. The backlight module with current balance circuit of claim 11, wherein said minimum voltage and said open loop detector is able to detect if LEDs connected in series within said plurality of light units are open circuit or if operating under minimum operating voltage.

13. The backlight module with current balance circuit of claim 6, wherein said boost unit includes a boost converter and a PWM signal generator.

14. The backlight module with current balance circuit of claim 6, wherein said open loop detection circuit includes:

a first inverter and a second inverter, wherein output of said first inverter is connected to input of said second inverter;

a transmission gate, connected to output of said second inverter and input of said comparator; and a semiconductor switch, connected to said transmission gate and said input of said comparator.

15. The backlight module with current balance circuit of claim 6, further comprising an error amplifier, connected between said boost unit and said detection unit.

* * * * *